US007264539B2

(12) United States Patent
Bastian et al.

(10) Patent No.: US 7,264,539 B2
(45) Date of Patent: Sep. 4, 2007

(54) SYSTEMS AND METHODS FOR REMOVING MICROFEATURE WORKPIECE SURFACE DEFECTS

(75) Inventors: Joseph A. Bastian, Boise, ID (US); Jeremey T. Reukauf, Emmit, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 11/181,341

(22) Filed: Jul. 13, 2005

(65) Prior Publication Data

US 2007/0015446 A1 Jan. 18, 2007

(51) Int. Cl.
*B24B 1/00* (2006.01)

(52) U.S. Cl. ..... 451/41; 451/54; 451/59

(58) Field of Classification Search ..... 451/56, 451/41, 36, 37, 54, 57, 59, 60
See application file for complete search history.

(56) References Cited

U.S. PATENT DOCUMENTS

| | | | |
|---|---|---|---|
| 5,020,283 | A | 6/1991 | Tuttle |
| 5,081,796 | A | 1/1992 | Schultz |
| 5,177,908 | A | 1/1993 | Tuttle |
| 5,232,875 | A | 8/1993 | Tuttle et al. |
| 5,234,867 | A | 8/1993 | Schultz et al. |
| 5,240,552 | A | 8/1993 | Yu et al. |
| 5,244,534 | A | 9/1993 | Yu et al. |
| 5,245,790 | A | 9/1993 | Jerbic |
| 5,245,796 | A | 9/1993 | Miller et al. |
| RE34,425 | E | 11/1993 | Schultz |
| 5,297,364 | A | 3/1994 | Tuttle |
| 5,314,843 | A | 5/1994 | Yu et al. |
| 5,421,769 | A | 6/1995 | Schultz et al. |
| 5,433,651 | A | 7/1995 | Lustig et al. |
| 5,449,314 | A | 9/1995 | Meikle et al. |
| 5,486,129 | A | 1/1996 | Sandhu et al. |
| 5,514,245 | A | 5/1996 | Doan et al. |
| 5,533,924 | A | 7/1996 | Stroupe et al. |
| 5,540,810 | A | 7/1996 | Sandhu et al. |
| 5,618,381 | A | 4/1997 | Doan et al. |
| 5,624,303 | A | 4/1997 | Robinson |
| 5,643,060 | A | 7/1997 | Sandhu et al. |
| 5,658,183 | A | 8/1997 | Sandhu et al. |
| 5,658,190 | A | 8/1997 | Wright et al. |

(Continued)

OTHER PUBLICATIONS

Kondos, S. et al., "Abrasive-Free Polishing for Copper Damascene Interconnection," Journal of the Electrochemical Society, vol. 147, No. 10, pp. 3907-3913, 2000.

*Primary Examiner*—Jacob K. Ackun, Jr.
(74) *Attorney, Agent, or Firm*—Perkins Coie LLP

(57) ABSTRACT

Systems and methods for removing microfeature workpiece surface defects are disclosed. A method for processing a microfeature workpiece in accordance with one embodiment includes removing surface defects from a surface of a microfeature workpiece by engaging the surface with a buffing medium having a first hardness, and moving at least one of the workpiece and the buffing medium relative to the other. After removing the surface defects and before adding additional material to the microfeature workpiece the method can further include engaging the microfeature workpiece with a polishing pad having a second hardness greater than the first hardness. Additional material can be removed from the microfeature workpiece by moving at least one of the microfeature workpiece and the polishing pad relative to the other.

42 Claims, 4 Drawing Sheets

U.S. PATENT DOCUMENTS

| | | | | |
|---|---|---|---|---|
| 5,664,988 | A | | 9/1997 | Stroupe et al. |
| 5,679,065 | A | | 10/1997 | Henderson |
| 5,681,423 | A | | 10/1997 | Sandhu et al. |
| 5,690,540 | A | | 11/1997 | Elliott et al. |
| 5,702,292 | A | | 12/1997 | Brunelli et al. |
| 5,730,642 | A | | 3/1998 | Sandhu et al. |
| 5,733,176 | A | | 3/1998 | Robinson et al. |
| 5,736,427 | A | | 4/1998 | Henderson |
| 5,738,567 | A | | 4/1998 | Manzonie et al. |
| 5,747,386 | A | | 5/1998 | Moore |
| 5,792,709 | A | | 8/1998 | Robinson et al. |
| 5,795,218 | A | | 8/1998 | Doan et al. |
| 5,795,495 | A | | 8/1998 | Meikle |
| 5,807,165 | A | | 9/1998 | Uzoh et al. |
| 5,823,855 | A | | 10/1998 | Robinson |
| 5,830,806 | A | | 11/1998 | Hudson et al. |
| 5,851,135 | A | | 12/1998 | Sandhu et al. |
| 5,868,896 | A | | 2/1999 | Robinson et al. |
| 5,871,392 | A | | 2/1999 | Meikle et al. |
| 5,879,222 | A | | 3/1999 | Robinson |
| 5,882,248 | A | | 3/1999 | Wright et al. |
| 5,893,754 | A | | 4/1999 | Robinson et al. |
| 5,895,550 | A | | 4/1999 | Andreas |
| 5,910,043 | A | | 6/1999 | Manzonie et al. |
| 5,919,082 | A | | 7/1999 | Walker et al. |
| 5,934,980 | A | | 8/1999 | Koos et al. |
| 5,938,801 | A | | 8/1999 | Robinson |
| 5,945,347 | A | | 8/1999 | Wright |
| 5,954,912 | A | | 9/1999 | Moore |
| 5,967,030 | A | | 10/1999 | Blalock |
| 5,972,792 | A | | 10/1999 | Hudson |
| 5,976,000 | A | | 11/1999 | Hudson |
| 5,980,363 | A | | 11/1999 | Meikle et al. |
| 5,981,396 | A | | 11/1999 | Robinson et al. |
| 5,989,470 | A | | 11/1999 | Doan et al. |
| 5,990,012 | A | | 11/1999 | Robinson et al. |
| 5,994,224 | A | | 11/1999 | Sandhu et al. |
| 5,997,384 | A | | 12/1999 | Blalock |
| 6,036,586 | A | | 3/2000 | Ward |
| 6,039,633 | A | | 3/2000 | Chopra |
| 6,040,245 | A | | 3/2000 | Sandhu et al. |
| 6,054,015 | A | | 4/2000 | Brunelli et al. |
| 6,062,958 | A | | 5/2000 | Wright et al. |
| 6,066,030 | A | | 5/2000 | Uzoh |
| 6,074,286 | A | | 6/2000 | Ball |
| 6,083,085 | A | | 7/2000 | Lankford |
| 6,090,475 | A | | 7/2000 | Robinson et al. |
| 6,106,351 | A | | 8/2000 | Raina et al. |
| 6,110,820 | A | | 8/2000 | Sandhu et al. |
| 6,116,988 | A | | 9/2000 | Ball |
| 6,120,354 | A | | 9/2000 | Koos et al. |
| 6,125,255 | A | | 9/2000 | Litman |
| 6,135,856 | A | | 10/2000 | Tjaden et al. |
| 6,136,043 | A | | 10/2000 | Robinson et al. |
| 6,139,402 | A | | 10/2000 | Moore |
| 6,143,123 | A | | 11/2000 | Robinson et al. |
| 6,143,155 | A | | 11/2000 | Adams et al. |
| 6,152,808 | A | | 11/2000 | Moore |
| 6,153,526 | A | * | 11/2000 | Shih et al. ..... 438/692 |
| 6,176,763 | B1 | | 1/2001 | Kramer et al. |
| 6,176,992 | B1 | | 1/2001 | Talieh |
| 6,186,870 | B1 | | 2/2001 | Wright et al. |
| 6,187,681 | B1 | | 2/2001 | Moore |
| 6,191,037 | B1 | | 2/2001 | Robinson et al. |
| 6,193,588 | B1 | | 2/2001 | Carlson et al. |
| 6,196,899 | B1 | | 3/2001 | Chopra et al. |
| 6,200,901 | B1 | | 3/2001 | Hudson et al. |
| 6,203,404 | B1 | | 3/2001 | Joslyn et al. |
| 6,203,407 | B1 | | 3/2001 | Robinson |
| 6,203,413 | B1 | | 3/2001 | Skrovan |
| 6,206,754 | B1 | | 3/2001 | Moore |
| 6,206,756 | B1 | | 3/2001 | Chopra et al. |
| 6,206,759 | B1 | | 3/2001 | Agarwal et al. |
| 6,210,257 | B1 | | 4/2001 | Carlson |
| 6,213,845 | B1 | | 4/2001 | Elledge |
| 6,218,316 | B1 | | 4/2001 | Marsh |
| 6,220,934 | B1 | | 4/2001 | Sharples et al. |
| 6,227,955 | B1 | | 5/2001 | Custer et al. |
| 6,234,874 | B1 | | 5/2001 | Ball |
| 6,234,877 | B1 | | 5/2001 | Koos et al. |
| 6,234,878 | B1 | | 5/2001 | Moore |
| 6,237,483 | B1 | | 5/2001 | Blalock |
| 6,244,944 | B1 | | 6/2001 | Elledge |
| 6,250,994 | B1 | | 6/2001 | Chopra et al. |
| 6,251,785 | B1 | | 6/2001 | Wright |
| 6,254,460 | B1 | | 7/2001 | Walker et al. |
| 6,261,151 | B1 | | 7/2001 | Sandhu et al. |
| 6,261,163 | B1 | | 7/2001 | Walker et al. |
| 6,267,650 | B1 | | 7/2001 | Hembree |
| 6,273,786 | B1 | | 8/2001 | Chopra et al. |
| 6,273,796 | B1 | | 8/2001 | Moore |
| 6,273,800 | B1 | | 8/2001 | Walker et al. |
| 6,276,996 | B1 | | 8/2001 | Chopra |
| 6,277,015 | B1 | | 8/2001 | Robinson et al. |
| 6,290,579 | B1 | | 9/2001 | Walker et al. |
| 6,296,557 | B1 | | 10/2001 | Walker |
| 6,306,012 | B1 | | 10/2001 | Sabde |
| 6,306,014 | B1 | | 10/2001 | Walker et al. |
| 6,306,768 | B1 | | 10/2001 | Klein |
| 6,309,282 | B1 | | 10/2001 | Wright et al. |
| 6,312,558 | B2 | | 11/2001 | Moore |
| 6,313,038 | B1 | | 11/2001 | Chopra et al. |
| 6,325,702 | B2 | | 12/2001 | Robinson |
| 6,328,632 | B1 | | 12/2001 | Chopra |
| 6,331,135 | B1 | | 12/2001 | Sabde et al. |
| 6,331,139 | B2 | | 12/2001 | Walker et al. |
| 6,331,488 | B1 | | 12/2001 | Doan et al. |
| 6,350,180 | B2 | | 2/2002 | Southwick |
| 6,350,691 | B1 | | 2/2002 | Lankford |
| 6,352,466 | B1 | | 3/2002 | Moore |
| 6,354,919 | B2 | | 3/2002 | Chopra |
| 6,354,923 | B1 | | 3/2002 | Lankford |
| 6,354,930 | B1 | | 3/2002 | Moore |
| 6,358,122 | B1 | | 3/2002 | Sabde et al. |
| 6,358,127 | B1 | | 3/2002 | Carlson et al. |
| 6,358,129 | B2 | | 3/2002 | Dow |
| 6,361,400 | B2 | | 3/2002 | Southwick |
| 6,361,417 | B2 | | 3/2002 | Walker et al. |
| 6,361,832 | B1 | | 3/2002 | Agarwal et al. |
| 6,364,749 | B1 | | 4/2002 | Walker |
| 6,364,757 | B2 | | 4/2002 | Moore |
| 6,368,190 | B1 | | 4/2002 | Easter et al. |
| 6,368,193 | B1 | | 4/2002 | Carlson et al. |
| 6,368,194 | B1 | | 4/2002 | Sharples et al. |
| 6,368,197 | B2 | | 4/2002 | Elledge |
| 6,376,381 | B1 | | 4/2002 | Sabde |
| 6,383,934 | B1 | | 5/2002 | Sabde et al. |
| 6,386,069 | B1 | | 5/2002 | Olivera et al. |
| 6,387,289 | B1 | | 5/2002 | Wright |
| 6,395,620 | B1 | | 5/2002 | Pan et al. |
| 6,402,884 | B1 | | 6/2002 | Robinson et al. |
| 6,409,586 | B2 | | 6/2002 | Walker et al. |
| 6,428,386 | B1 | | 8/2002 | Bartlett |
| 6,447,369 | B1 | | 9/2002 | Moore |
| 6,498,101 | B1 | | 12/2002 | Wang |
| 6,511,576 | B2 | | 1/2003 | Klein |
| 6,520,834 | B1 | | 2/2003 | Marshall |
| 6,533,893 | B2 | | 3/2003 | Sabde et al. |
| 6,547,640 | B2 | | 4/2003 | Hofmann |
| 6,548,407 | B1 | | 4/2003 | Chopra et al. |
| 6,579,799 | B2 | | 6/2003 | Chopra et al. |
| 6,592,443 | B1 | | 7/2003 | Kramer et al. |
| 6,609,947 | B1 | | 8/2003 | Moore |
| 6,623,329 | B1 | | 9/2003 | Moore |

6,633,084 B1 10/2003 Sandhu et al.
6,652,764 B1 11/2003 Blalock
6,666,749 B2 12/2003 Taylor
6,709,544 B2 * 3/2004 Hu et al. ..... 156/345.12
7,030,603 B2 4/2006 Ramarajan
2004/0235398 A1 * 11/2004 Thornton et al. ..... 451/41
2006/0170413 A1 8/2006 Ramarajan

* cited by examiner

SYSTEMS AND METHODS FOR REMOVING MICROFEATURE WORKPIECE SURFACE DEFECTS

TECHNICAL FIELD

The present invention is directed generally to systems and methods for removing microfeature workpiece surface defects, for example, prior to planarizing such workpieces.

BACKGROUND

Mechanical and chemical-mechanical planarization and polishing processes (collectively "CMP") remove material from the surfaces of microfeature workpieces in the production of microelectronic devices and other products. FIG. 1 schematically illustrates a system that includes a rotary CMP machine 10 and a buffing machine 20. The CMP machine 10 has a platen 16, a polishing pad 31 on the platen 16, and a carrier 11 adjacent to the polishing pad 31. A platen drive assembly 17 rotates the platen 16 and polishing pad 31 (as indicated by arrow A) and/or reciprocates the platen 16 and polishing pad 31 back and forth (as indicated by arrow B) during planarization. The carrier 11 has a carrier head 19 to which a microfeature workpiece 50 may be attached. The carrier head 19 may be a weighted, free-floating wafer carrier, or a carrier actuator assembly 12 may be attached to the carrier head 19 to impart rotational motion to the microfeature workpiece 50 (as indicated by arrow C) and/or reciprocate the workpiece 50 back and forth (as indicated by arrow D).

The polishing pad 31 and a polishing solution 32 define a polishing medium 30 that mechanically and/or chemically-mechanically removes material from the surface of the microfeature workpiece 50. The polishing solution 32 may be a conventional CMP slurry with abrasive particles and chemicals that etch and/or oxidize the surface of the microfeature workpiece 50, or the polishing solution 12 may be a "clean" nonabrasive planarizing solution without abrasive particles. In most CMP applications, abrasive slurries with abrasive particles are used on nonabrasive polishing pads, and clean nonabrasive solutions without abrasive particles are used on fixed-abrasive polishing pads.

To planarize the microfeature workpiece 50 with the CMP machine 10, the carrier head 19 presses the workpiece 50 face-down against the polishing pad 31. More specifically, the carrier head 19 generally presses the microfeature workpiece 50 against the polishing solution 32 on a polishing surface 33 of the polishing pad 31, and the platen 16 and/or the carrier head 19 move to rub the workpiece 50 against the polishing surface 33. As the microfeature workpiece 50 rubs against the polishing surface 33, the polishing medium 30 removes material from the face of the workpiece 50.

After the microfeature workpiece 50 has been polished, it is moved to the buffing machine 20. The buffing machine 20 includes many features generally similar to those of the CMP machine 10, but instead of the polishing medium 30, the buffing machine 20 includes a buffing medium 40. The buffing medium 40 in turn includes a buffing pad 41 having a buffing surface 43 that supports a buffing solution 42. The buffing solution 42 can be the same as or different than the polishing solution 32. The buffing surface 43 is generally softer than the polishing surface 33 so as to gently remove residual contaminants from the workpiece 50 after the preceding CMP operation.

While the foregoing technique has proved useful for removing at least some surface defects from the microfeature workpiece 50 after a CMP operation, such defects still may form, and such defects may not always be removed via the buffing technique. Accordingly, it may be desirable to further improve the uniformity of workpieces that are processed using CMP techniques.

DETAILED DESCRIPTION

Figure 1:
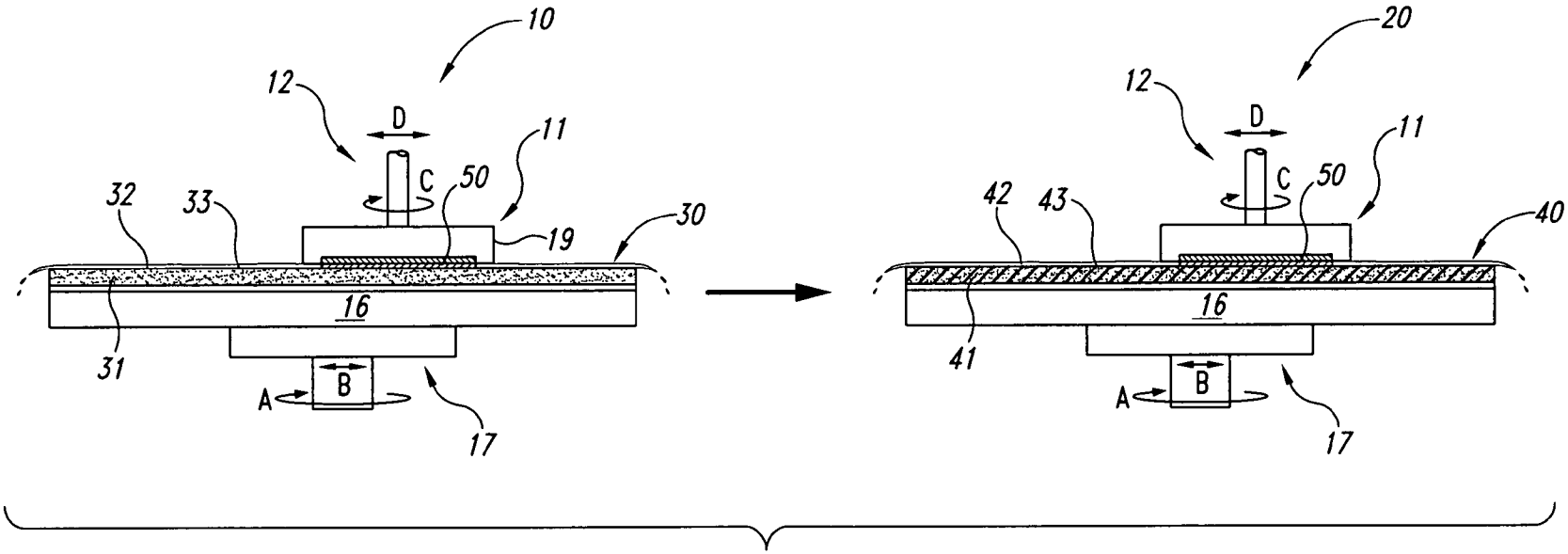
Fig. 1 (Prior Art)
FIG. 1 is a partially schematic illustration of a CMP machine and a buffing machine configured in accordance with the prior art.

The present invention is directed generally toward systems and methods for removing microfeature workpiece surface defects. One of the drawbacks associated with the arrangement described above with reference to FIG. 1 is that the microfeature workpiece may arrive at the CMP machine with contaminant materials already carried by and/or embedded in the surfaces of the workpiece. It is believed that such contaminants may contribute to the formation of additional surface defects during the ensuing CMP operation, and that not all such surface defects may be effectively removed by a post-CMP buffing process. As a result, the existing methods and tools may not produce microfeature workpieces having the desired level of planarity and uniformity.

One aspect of the invention is directed toward a method for processing a microfeature workpiece, and includes removing surface defects from a surface of the microfeature workpiece by engaging the surface with a buffing medium having a first hardness, and moving at least one of the workpiece and the polishing medium relative to the other. The method can further include engaging the microfeature workpiece with a polishing pad having a second hardness greater than the first hardness, after removing the surface defects, and before adding additional material to the microfeature workpiece. Material can then be removed from the microfeature workpiece by moving at least one of the microfeature workpiece and the polishing pad relative to the other.

In particular embodiments, the buffing medium can have a Shore D hardness of about zero, while the polishing pad can have a Shore D hardness of about 20 or higher (e.g., from about 50 to about 60). Removing the surface defects can include removing a layer having a thickness of less than 10 microns from the microfeature workpiece. In still further particular embodiments, removing surface defects can include removing particulate contaminants, surface scratches, or both.

An apparatus in accordance with another aspect of the invention includes a first station having a buffing medium with a first hardness, a second station having a polishing pad with a second hardness greater than the first, and an automated transfer device positioned to move a microfeature workpiece between the first and second stations. The apparatus can further include a controller operatively coupled to the automated transfer device. The controller can contain instructions for directing the automated transfer device to place a microfeature workpiece at the first station before placing the same microfeature workpiece at the second station.

In yet another aspect, an apparatus for processing microfeature workpieces can include a first station having a buffing medium with a first hardness, a second station having a polishing pad with a second hardness greater than the first, and a third station having a buffing medium with a third hardness less than the second. The apparatus can further include an automated transfer device positioned to move a microfeature workpiece among the first, second and third stations. In particular aspects, the apparatus can further comprise a controller operatively coupled to the automated transfer device, with the controller containing instructions for directing the automated transfer device to place a microfeature workpiece at the first station before placing the same microfeature workpiece at the second station. The controller can further include instructions for directing the automated transfer device to place the microfeature workpiece at the third station after placing the same microfeature workpiece at the second station.

As used herein, the terms "microfeature workpiece" and "workpiece" refer to substrates in and/or on which microelectronic devices are integrally formed. Microfeature polishing pads typically include pads configured to remove material from microfeature workpieces during the formation of micro-devices. Typical micro-devices include microelectronic circuits or components, thin-film recording heads, data storage elements, microfluidic devices, and other products. Micromachines and micromechanical devices are included within this definition because they are manufactured using much of the same technology that is used in the fabrication of integrated circuits. Substrates can be semiconductive pieces (e.g., doped silicon wafers or gallium arsenide wafers), non-conductive pieces (e.g., various ceramic substrates), or conductive pieces. In some cases, the workpieces are generally round, and in other cases, the workpieces have other shapes, including rectilinear shapes. Several embodiments of buffing media and associated systems and tools are described below. A person skilled in the relevant art will understand, however, that the invention may have additional embodiments, and that the invention may be practiced without several of the details of the embodiments described below with reference to FIGS. 2A-4.

Figure 2A:
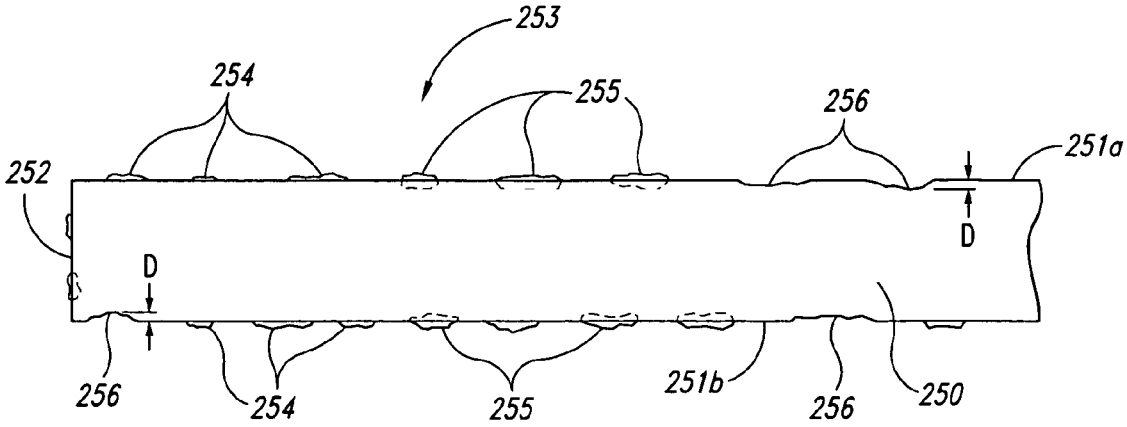
FIG. 2A is a partially schematic illustration of a portion of a microfeature workpiece having surface defects prior to undergoing a CMP operation.

FIG. 2A is a partially schematic illustration of a portion of a microfeature workpiece 250, illustrating surface defects 253 that may be present before the microfeature workpiece 250 undergoes a CMP process. The microfeature workpiece 250 can include two major surfaces 251 (shown as first and second major surfaces 251*a*, 251*b*) and an intermediate edge surface 252. Any of these surfaces can include one or more surface defects 253. For purposes of illustration, the surface defects 253 are shown schematically and are not shown to scale. The surface defects 253 can include surface contaminants 254, e.g., particulates that rest on and/or adhere to the surface, but are not embedded in the surface. The surface defects 253 can also include partially embedded contaminants 255 that may be more firmly attached to the surface. The surface defects 253 can still further include surface scratches 256 that extend a short distance D from the corresponding surface. In one embodiment, the surface scratches 256 can extend for a distance D that is on the order of a few hundred angstroms or less (e.g., less than 10 microns).

Figure 2B:
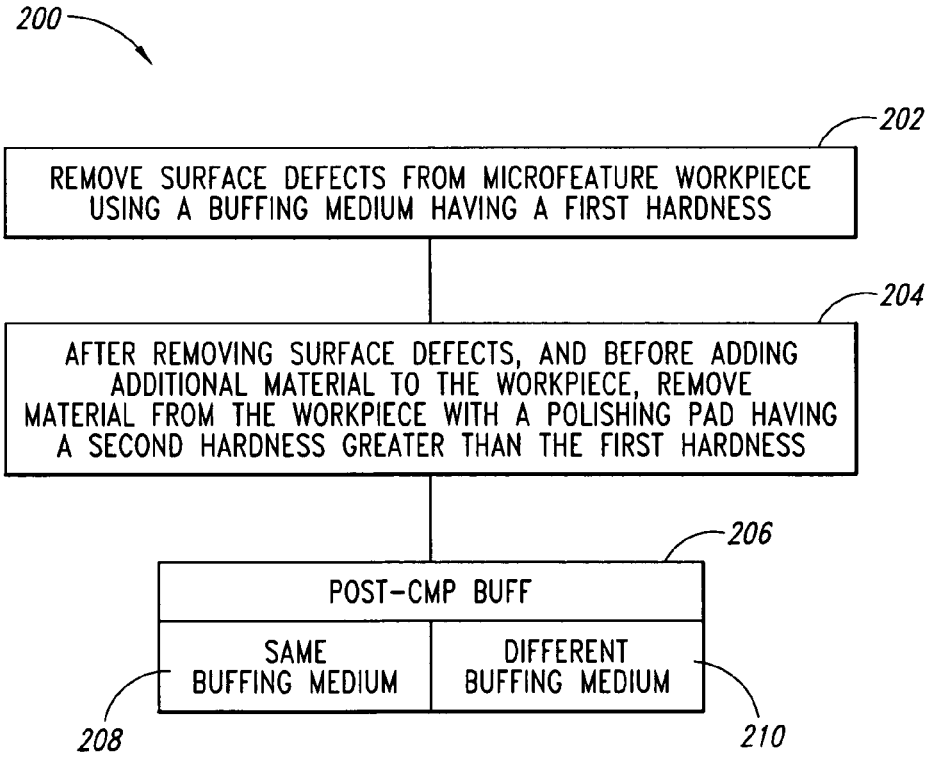
FIG. 2B is a flow diagram illustrating a method for removing surface defects from a microfeature workpiece prior to CMP processing.

It is believed that if at least some of the foregoing surface defects (e.g., the surface contaminants 254 and/or partially embedded contaminants 255) break away from the microfeature workpiece 250 during CMP processing, they may damage the microfeature workpiece 250, for example, by causing scratches. Accordingly, aspects of the invention are directed to methods for reducing or eliminating the likelihood for such damage to occur. FIG. 2B is a flow diagram illustrating a process 200 for handling a microelectronic workpiece prior to a CMP operation. The process 200 can include removing surface defects from a microfeature workpiece using a buffing medium having a first hardness (process portion 202). After removing the surface defects, and before adding additional material to the workpiece, the method can further include removing material from the workpiece with a polishing pad having a second hardness greater than the first hardness (process portion 204). For example, process portion 204 can include polishing and/or planarizing the microfeature workpiece in a CMP process after buffing the workpiece, but before adding a new layer of material (e.g., a metal or dielectric material) to the workpiece. After the workpiece has been polished and/or planarized, the method can include a post-CMP buff (process portion 206). In one aspect of this embodiment, the post-CMP buff can be carried out by the same buffing medium as was used to carry out the initial buffing process (process portion 208). In another embodiment, a different buffing medium can be used for post-CMP buffing (process portion 210). Further details of systems for carrying out the foregoing processes are described below with reference to FIGS. 3 and 4.

Figure 3:
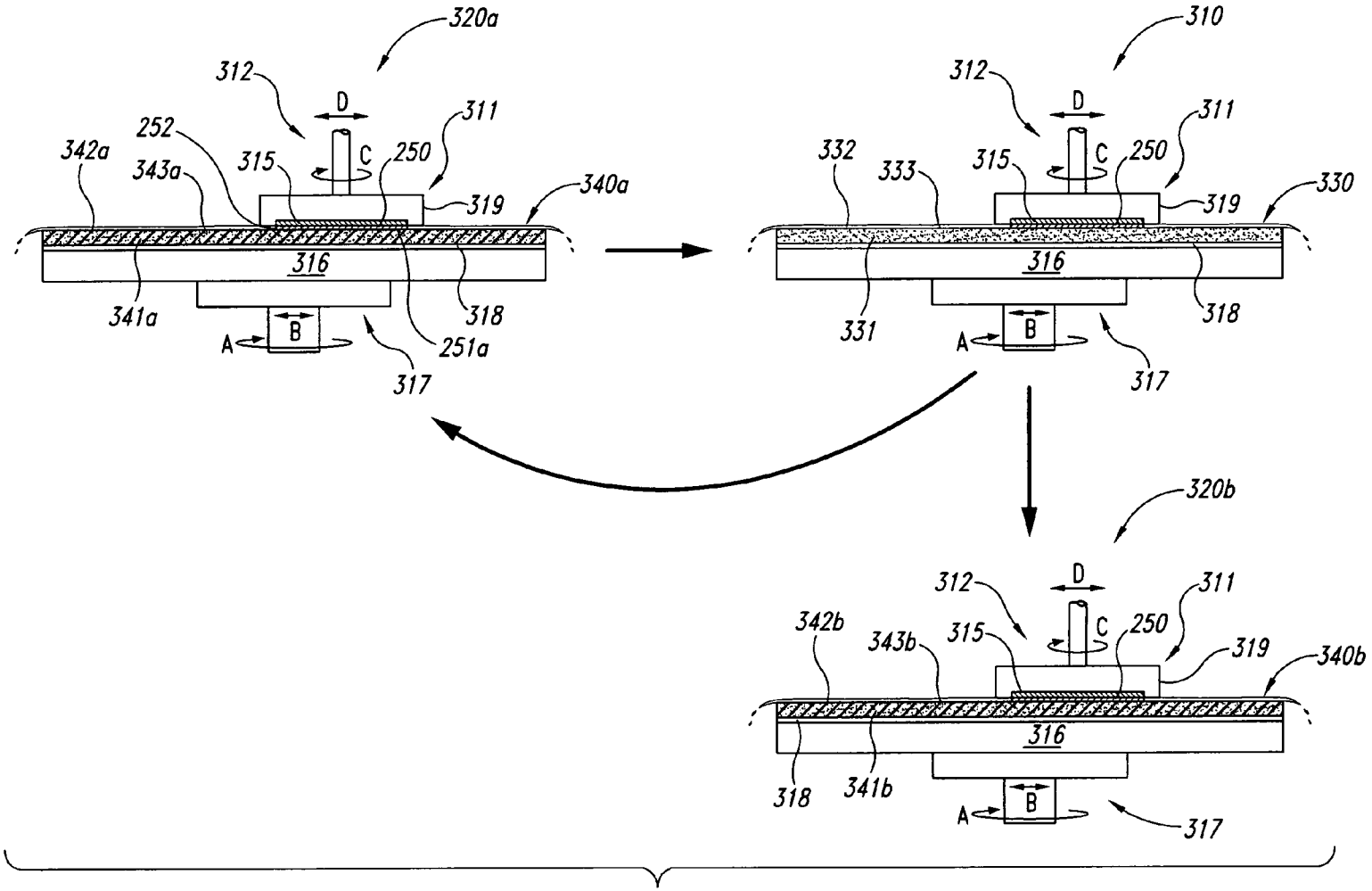
FIG. 3 is a partially schematic illustration of system components that may be used to remove material from a microfeature workpiece prior to a CMP operation.

FIG. 3 is a partially schematic illustration of a first buffing machine 320*a*, a planarizing machine 310, and an optional second buffing machine 320*b*. The buffing machines 320*a*, 320*b* and the planarizing machine 310 can include several common features. Such features include a platen 316 coupled to a drive assembly 317 for rotational movement (indicated by arrow A) and/or a translational movement (indicated by arrow B). A carrier 311 can be positioned proximate to the platen 317 and can include a carrier head 319 coupled to an actuator assembly 312 for rotational motion (indicated by arrow C) and/or a translational motion (indicated by arrow D). The carrier head 319 can include a resilient pad 315 that is positioned to contact a microfeature workpiece 250 carried by the carrier 311 for movement relative to the platen 316.

The platens 316 of the buffing machines 320*a*, 320*b* can support buffing media 340 (shown as a first buffing machine 340*a* and a second buffing machine 340*b*), while the platen 316 of the planarizing machine 310 can support a polishing medium 330. For example, the first buffing machine 320*a* can include a first buffing medium 340*a* that in turn includes a first buffing pad 341*a* and a first buffing solution 342*a*. The first buffing pad 341*a* is carried on the platen 316 by an underpad 318 and has an outwardly facing buffing surface 343*a* that contacts the downwardly facing surface 251 a of the microfeature workpiece 250.

The first buffing pad 341*a* can be softer than a typical CMP polishing pad. For example, the first buffing pad 341*a* can have a Shore D hardness of about zero in one embodiment. The first buffing pad 341*a* can include a generally spongy material and can have a configuration generally similar to that of a Politex or UR2 pad available from Rohm & Haas Electronic Materials of Philadelphia, Pa. In at least some embodiments, the first buffing pad 341*a* can be compliant enough that, with a selected level of down force applied by the carrier head 319 to the microfeature workpiece 250, the first buffing pad 341*a* can remove material from the edge surfaces 252 of the microfeature workpiece 250. The action of the first buffing pad 341*a* can be assisted by the first buffing solution 342*a*. In one embodiment, the first buffing solution 342*a* can include a conventional CMP slurry, and in other embodiments, the first buffing solution 342*a* can have other compositions.

In any of the foregoing embodiments, the process of buffing the microfeature workpiece 250 at the first buffing machine 320*a* can remove some or all of the surface defects 253 described above with reference to FIG. 2A. After such defects have been removed, the microfeature workpiece 250 can be moved to the CMP machine 310 for planarizing and/or polishing. The CMP machine 310 can include components generally similar to those described above with reference to the first buffing machine 320*a*, except that the first buffing medium 340*a* can be replaced with a polishing medium 330. The polishing medium 330 can include a polishing pad 331 having a polishing surface 333 on which a polishing solution 332 is disposed. The polishing pad 331 can be harder than the first buffing pad 341*a* to remove more substantial quantities of material from the surface of the microfeature workpiece 250. For example, the polishing pad 331 can have a Shore D hardness of about 20 or higher in some embodiments, and a Shore D hardness of from about 50 to about 60 in further particular embodiments. Accordingly, while the first buffing medium 340*a* may tend to remove surface defects, including scratches to a depth of less than about 10 microns, the polishing medium 330 may be used to remove more significant amounts of material, including layers having thicknesses on the order of tens or hundreds of microns.

The process of polishing the microfeature workpiece 250 may also leave residual surface defects, which can be removed in a post-CMP buffing process. In one embodiment, the microfeature workpiece 250 can be returned to the first buffing machine 320*a* for removal of surface defects caused by the processes carried out at the CMP machine 310. In another embodiment, the microfeature workpiece 250 can be moved to the second buffing machine 320*b* for removal of such surface, defects. The second buffing machine 320*b* can be generally similar to the first buffing machine 320*a*, and can include a second buffing medium 340*b*. The second buffing medium 340*b* can include a second buffing pad 341*b* having a second buffing surface 343*b* which carries a second buffing solution 342*b*. In some embodiments, the second buffing pad 341*b* and/or the second buffing solution 342*b* can be the same as the corresponding first buffing pad 341*a* and the first buffing solution 342*a*. In other embodiments, either or both of these components can be different. For example, if the nature of the surface defects to be removed after CMP processing is different than the nature of the surface defects to be removed prior to CMP processing, the second buffing medium 340*b* can be different than the first polishing medium 340*a*. In further particular instances, the hardness of the second buffing pad 341*b* can be different than the hardness of the first buffing pad 341*a*, and/or the chemical and/or abrasive characteristics of the second buffing solution 342*b* can be different than the corresponding characteristics of the first buffing solution 342*a*.

In some embodiments, the second buffing machine 320*b*, if used, may be located at a tool that is different than a tool that carries the first buffing machine 320*a* and the CMP machine 310. In such an embodiment, the microfeature workpiece 250 can be transported in a suitable container to the second buffing machine 320*b* for a post-CMP buffing process. In other embodiments, the CMP machine 310 can also be located at a different tool than the first buffing machine 320*a*, in which case the microfeature workpiece 250 is transported from the first buffing machine 320*a* to the CMP machine 310, also in a suitable container. In still further embodiments, all three machines can be co-located in a single tool, as described below with reference to FIG. 4.

Figure 4:
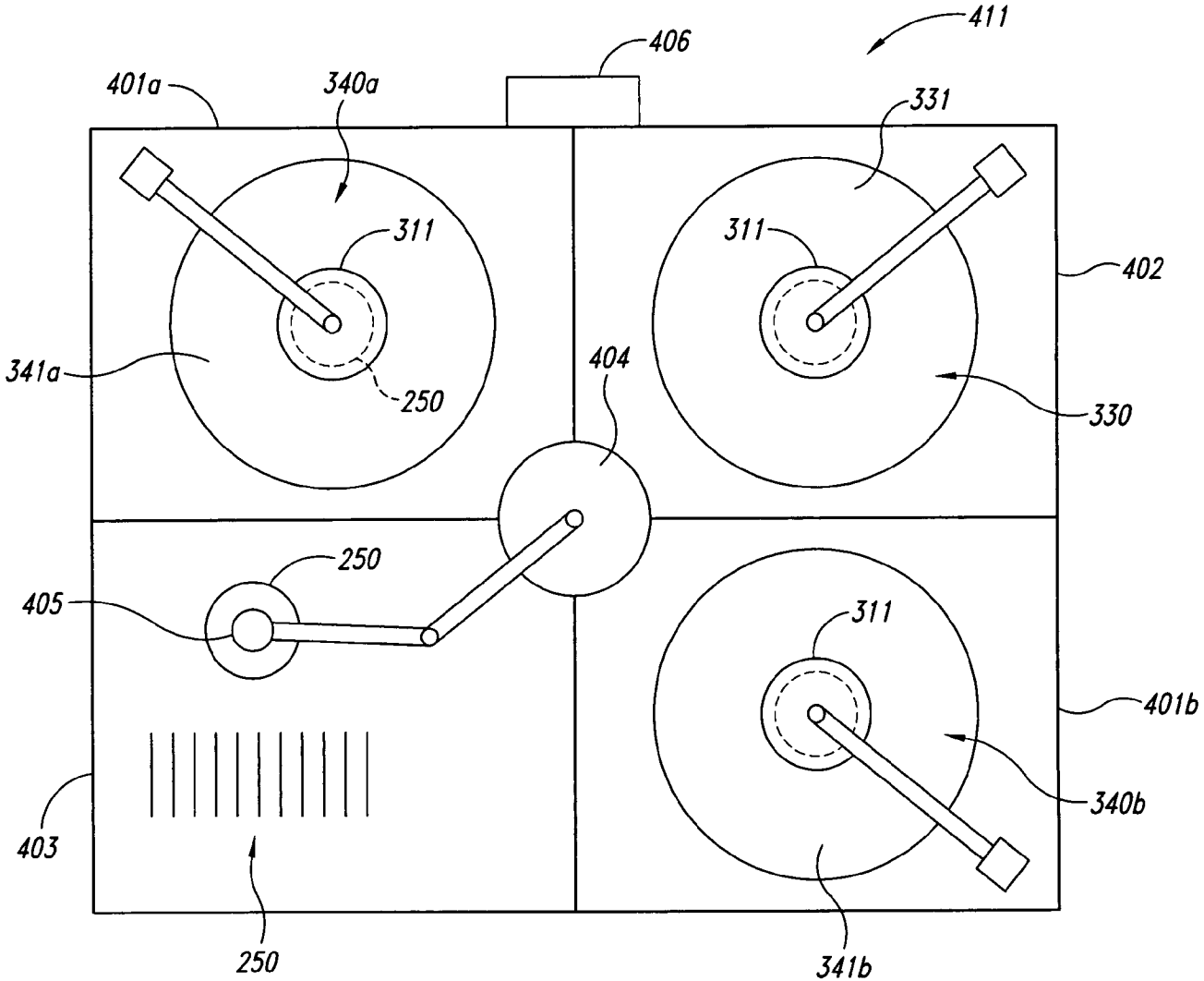
FIG. 4 is a partially schematic, plan view of a tool configured to planarize microfeature workpieces and remove surface defects from such workpieces before and after planarization.

FIG. 4 is a partially schematic, top plan view of a tool 411 that includes a polishing station 402 and multiple buffing stations 401 (shown as a first buffing station 401*a* and a second buffing station 401*b*). The tool 411 can also include an I/O station 403 at which microfeature workpieces 250 enter and exit the tool 411. An automated transfer device 404 (e.g., a robot) can include an end effector 405 suitable for moving the workpieces 250 from the I/O station 403 among the various other stations of the tool for processing, and then back to the I/O station 403 after processing has been completed.

The first buffing station 401*a* can include the first buffing medium 340*a*, and the second buffing station 401*b* can include the second buffing medium 340*b*. The polishing station 402 can include the polishing medium 330. In operation, the automated transfer device 404 can move a microfeature workpiece 250 from the I/O station 403 to the first buffing station 401*a* where surface defects are removed prior to polishing/planarization. The automated transfer device 404 can then, move the microfeature workpiece 250 to the polishing station 402 for polishing/planarization using a polishing pad 331 having a hardness greater than the first buffing pad 341*a*. As described above with reference to FIG. 2A, the microfeature workpiece 250 can be moved from the first buffing station 401*a* to the polishing station 402 without undergoing an intermediate material application process. However, the microfeature workpiece 250 may undergo other intermediate processes, for example, a rinsing process.

In one mode of operation, the microfeature workpiece 250 can then be moved to the second buffing station 401*b* for a post-CMP buffing process and then back to the input/output station 403 for removal from the tool 411. In another embodiment, for example, when the second buffing medium 340*b* is the same as the first buffing medium 340*a*, the microfeature workpiece 250 can be moved from the polishing station 402 to whichever buffing station 401*a*, 401*b* is available at that time.

Directions for the motion of the automated transfer device 404 can be provided by a controller 406 that is operatively coupled to the automated transfer device 404. The controller 406 .can include a programmable computer, and the directions can include computer-executable instructions, including routines executed by the programmable computer. The term "computer" as generally used herein refers to any data processor and can include hand-held devices (including palm-top computers, wearable computers, cellular or mobile phones, multi-processor systems, processor-based or programmable consumer electronics, network computers, mini computers and the like). Directions and/or related aspects of the invention may be stored or distributed on computer-readable media, including magnetic or optically readable or removable computer disks, as well as distributed electronically over networks. The directions may be "hard-wired" functions carried out by the computer, and/or the directions or particular portions of the directions may be changeable, for example, by an end-user or by service personnel.

One feature of at least some of the foregoing embodiments is that they can include removing surface defects from a surface of a microfeature workpiece via a buffing medium, before engaging the microfeature workpiece (or a surface thereof) with a polishing medium, and before applying additional material to the microfeature workpiece (or a surface thereof). For example, the removed surface defects can include constituents that would otherwise break away from the microfeature workpiece when contacted with the polishing pad. An expected benefit of this arrangement is that it will reduce or eliminate the number of surface defects in the microfeature workpiece prior to a CMP material removal process, and can therefore rehabilitate a workpiece having surface defects. It is believed that such surface defects may, when placed in contact with a relatively hard polishing pad, scratch or further scratch the surface of the microfeature workpiece and create additional surface defects. Accordingly, by removing surface defects prior to the polishing process, the likelihood for creating additional surface defects can be reduced or eliminated.

Another feature of at least some embodiments of the foregoing arrangement is that they can include a tool having both a pre-CMP buffing station and a post-CMP buffing station, for example, as shown in FIG. 4. This is unlike at least some conventional tools (e.g., the Mirra polishing tool, available from Applied Materials of Santa Clara, Calif.) which include a single buffing station and multiple CMP stations. An advantage of arrangements having features such as those described above with reference to FIG. 4 is that they can support continuous processing of microfeature workpieces in a manner that includes both buffing the workpiece before conducting a CMP process, and buffing the microfeature workpiece after conducting a CMP process. As described above, this arrangement can reduce and/or eliminate the likelihood for creating additional surface defects on the microfeature workpiece.

From the foregoing, it will be appreciated that specific embodiments of the invention have been described herein for purposes of illustration, but that various modifications may be made without deviating from the invention. For example, particular aspects of the invention have been described in the context of rotary buffing and CMP stations, while in other embodiments, the buffing and/or polishing media described above can be applied to linearly actuated (e.g., web format) machines that include buffing and/or polishing pads wound from a supply roller to the takeup roller. Aspects of the invention described in the context of particular embodiments may be combined or eliminated in other embodiments. For example, the second buffing machine 320*b* described above with reference to FIG. 3 may be eliminated in some embodiments. Further, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited except as by the appended claims.

We claim:

1. A method for processing a microfeature workpiece, comprising:

adding a first layer of material to the microfeature workpiece;

buffing the microfeature workpiece to remove surface defects from a surface of the first layer of material on the microfeature workpiece by engaging a buffing medium with the surface when the microfeature workpiece is disposed on a first platen and moving at least one of the microfeature workpiece and the buffing medium relative to the other, the buffing medium having a first hardness;

after buffing the microfeature workpiece, and before adding a second layer of material to the microfeature workpiece, moving the microfeature workpiece to a second platen different from the first platen and performing a chemical-mechanical polishing process by engaging the microfeature workpiece with a polishing pad and removing material from the first layer of material, the polishing pad having a second hardness greater than the first hardness; and adding the second layer of material to the microfeature workpiece after performing the chemical-mechanical polishing process.

2. The method of claim 1 wherein removing surface defects includes removing a layer having a thickness of less than ten microns from the microfeature workpiece.

3. The method of claim 1 wherein engaging the microfeature workpiece includes engaging the microfeature workpiece before adding the second layer of material to the surface of the microfeature workpiece from which the surface defects were removed.

4. The method of claim 1 wherein engaging a buffing medium includes engaging a buffing pad having a Shore D hardness of about zero.

5. The method of claim 1 wherein engaging the microfeature workpiece with a polishing pad includes engaging the microfeature workpiece with a polishing pad having a Shore D hardness of about 20 or higher.

6. The method of claim 1 wherein engaging the microfeature workpiece with a polishing pad includes engaging the microfeature workpiece with a polishing pad having a Shore D hardness of from about 50 to about 60.

7. The method of claim 1, further comprising removing additional surface defects from the surface of the microfeature workpiece after engaging the microfeature workpiece with the polishing pad, wherein removing additional surface defects includes engaging the buffing medium with the surface and moving at least one of the microfeature workpiece and the buffing medium relative to the other.

8. The method of claim 1 wherein the buffing medium is a first buffing medium and wherein the method further comprises:

engaging a second buffing medium with the surface of the microfeature workpiece after engaging the microfeature workpiece with the polishing pad, the second buffing medium having a hardness less than the second hardness; and removing additional surface defects by moving at least one of the microfeature workpiece and the second buffing medium relative to the other.

9. The method of claim 1 wherein buffing the microfeature workpiece includes removing particulate contaminants, or surface scratches, or both.

10. The method of claim 1 wherein buffing the microfeature workpiece includes removing particulate contaminants carried by the surface.

11. The method of claim 1 wherein buffing the microfeature workpiece includes removing particulate contaminants embedded in the surface.

12. The method of claim 1 wherein buffing the microfeature workpiece includes removing constituents that would otherwise break away from the microfeature workpiece when contacted with the polishing pad.

13. The method of claim 1 wherein buffing the microfeature workpiece from a surface of a microfeature workpiece includes removing surface defects from an edge surface of the microfeature workpiece.

14. The method of claim 1, wherein buffing the microfeature workpiece from a surface of a microfeature workpiece includes removing surface defects from a major surface of the microfeature workpiece.

15. The method of claim 1, wherein the buffing medium includes a buffing pad, and wherein the method further comprises disposing a slurry between the microfeature workpiece and the buffing pad.

16. The method of claim 1, further comprising transferring the workpiece directly from the buffing medium to the polishing pad after removing surface defects from a surface of the workpiece.

17. The method of claim 1, further comprising:

moving the microfeature workpiece from the buffing medium to the polishing pad after removing surface defects from a surface of the microfeature workpiece by placing the microfeature workpiece in a transfer container and transferring the microfeature workpiece in the transfer container to the polishing pad.

18. A method for processing a microfeature workpiece, comprising:

adding a first layer of material to the microfeature workpiece;

rehabilitating a surface of the microfeature workpiece to remove surface defects from a surface of the first layer of material on the microfeature workpiece by buffing the microfeature workpiece via engaging a buffing medium with the surface and moving at least one of the microfeature workpiece and the buffing medium relative to the other when the microfeature workpiece is disposed on a first platen, the buffing medium having a first hardness;

after rehabilitating the surface, and before adding a second layer of material to the microfeature workpiece, moving the microfeature workpiece to a second platen different from the first platen and performing a chemical-mechanical polishing process by engaging the microfeature workpiece with a polishing pad and removing material from the microfeature workpiece, the polishing pad having a second hardness greater than the first hardness; and adding the second layer of material to the microfeature workpiece after performing the chemical-mechanical polishing process.

19. The method of claim 18 wherein rehabilitating a surface includes removing a layer having a thickness of less than ten microns from the microfeature workpiece.

20. The method of claim 18 wherein engaging a buffing medium includes engaging a buffing pad having a Shore D hardness of about zero.

21. The method of claim 18 wherein engaging the microfeature workpiece with a polishing pad includes engaging the microfeature workpiece with a polishing pad having a Shore D hardness of about 20 or higher.

22. The method of claim 18 wherein engaging the microfeature workpiece with a polishing pad includes engaging the microfeature workpiece with a polishing pad having a Shore D hardness of from about 50 to about 60.

23. The method of claim 18, further comprising further rehabilitating the surface of the microfeature workpiece after engaging the microfeature workpiece with the polishing pad, wherein further rehabilitating the surface includes engaging the buffing medium with the surface and moving at least one of the microfeature workpiece and the buffing medium relative to the other.

24. The method of claim 18 wherein the buffing medium is a first buffing medium and wherein the method further comprises:

engaging a second buffing medium with the surface of the microfeature workpiece after engaging the microfeature workpiece with the polishing pad, the second buffing medium having a hardness less than the second hardness; and further rehabilitating the surface by moving at least one of the microfeature workpiece and the second buffing medium relative to the other.

25. The method of claim 18 wherein rehabilitating a surface includes removing particulate contaminants or surface scratches, or both.

26. The method of claim 18 wherein rehabilitating a surface includes removing particulate contaminants carried by the surface.

27. The method of claim 18 wherein rehabilitating a surface includes removing particulate contaminants embedded in the surface.

28. The method of claim 18 wherein rehabilitating a surface includes removing constituents that would otherwise break away from the microfeature workpiece when contacted with the polishing pad.

29. The method of claim 18 wherein rehabilitating a surface of a microfeature workpiece includes removing surface defects from an edge surface of the microfeature workpiece.

30. The method of claim 18 wherein rehabilitating a surface of a microfeature workpiece includes removing surface defects from a major surface of the microfeature workpiece.

31. The method of claim 18 wherein the buffing medium includes a polishing pad, and wherein the method further comprises disposing a slurry between the microfeature workpiece and the buffing pad.

32. A method for processing a microfeature workpiece having a first exposed surface, wherein the first exposed surface has not undergone a CMP process, comprising:

buffing the first exposed surface of the microfeature workpiece to remove surface defects from the first exposed surface by engaging a buffing medium with the first exposed surface when the microfeature workpiece is disposed on a first platen, the buffing medium having a first hardness;

after buffing the first exposed surface, and before adding additional material to the microfeature workpiece, moving the microfeature workpiece to a second platen different from the first platen and performing a chemical-mechanical polishing process on the first exposed surface by engaging the microfeature workpiece with a polishing pad and removing material from the first exposed surface to create a second exposed surface different from the first exposed surface, the polishing pad having a second hardness greater than the first hardness; and adding the additional material to the microfeature workpiece after performing the chemical-mechanical polishing process.

33. The method of claim 32 wherein engaging a buffing medium includes engaging a buffing pad having a Shore D hardness of about zero.

34. The method of claim 32 wherein engaging the microfeature workpiece with a polishing pad includes engaging the microfeature workpiece with a polishing pad having a Shore D hardness of about 20 or higher.

35. The method of claim 32 wherein engaging the microfeature workpiece with a polishing pad includes engaging the microfeature workpiece with a polishing pad having a Shore D hardness of from about 50 to about 60.

36. The method of claim 32, further comprising buffing the second exposed surface to remove additional surface defects from the second exposed surface of the microfeature workpiece after engaging the microfeature workpiece with the polishing pad.

37. The method of claim 36, wherein removing additional surface defects includes engaging the buffing medium with the second exposed surface and moving at least one of the microfeature workpiece and the buffing medium relative to the other.

38. The method of claim 32 wherein the buffing medium is a first buffing medium and wherein the method further comprises:

engaging a second buffing medium with the second exposed surface of the microfeature workpiece after engaging the microfeature workpiece with the polishing pad, the second buffing medium having a hardness less than the second hardness; and removing additional surface defects by moving at least one of the microfeature workpiece and the second buffing medium relative to the other.

39. The method of claim 32 wherein buffing the first exposed surface includes removing particulate contaminants carried by the first exposed surface and/or at least partially embedded in the first exposed surface, or surface scratches, or both.

40. The method of claim 32, further comprising removing surface defects from an edge surface of the microfeature workpiece.

41. The method of claim 32, wherein buffing the first exposed surface includes removing surface defects from a major surface of the microfeature workpiece.

42. The method of claim 32 wherein moving the microfeature workpiece to a second platen includes placing the microfeature workpiece in a transfer container and transferring the microfeature workpiece in the transfer container to the second platen.

* * * * *